US006209655B1

(12) United States Patent
Valkanas

(10) Patent No.: US 6,209,655 B1
(45) Date of Patent: Apr. 3, 2001

(54) METHOD AND PRODUCTS TO FIGHT FIRES

(75) Inventor: George N. Valkanas, Maroussi (GR)

(73) Assignee: Innoval Management Limited, Curacao (AN)

( * ) Notice: Subject to any disclaimer, the term of this patent is extended or adjusted under 35 U.S.C. 154(b) by 0 days.

(21) Appl. No.: 09/230,223

(22) PCT Filed: Jul. 15, 1997

(86) PCT No.: PCT/GR97/00028

§ 371 Date: Mar. 22, 1999

§ 102(e) Date: Mar. 22, 1999

(87) PCT Pub. No.: WO98/03228

PCT Pub. Date: Jan. 29, 1998

(30) Foreign Application Priority Data

Jul. 22, 1996 (GR) ..... 960100257

(51) Int. Cl.[7] ..... A62C 2/00

(52) U.S. Cl. ..... 169/46; 169/43; 169/44; 169/DIG. 2; 252/2; 252/8.05; 252/610

(58) Field of Search ..... 169/24, 45, 46, 169/47, 52, 53, 44, DIG. 2, 43; 252/2, 3, 8.05, 605, 609, 610

(56) References Cited

U.S. PATENT DOCUMENTS

| | | | | |
|---|---|---|---|---|
| 3,853,987 | * | 12/1974 | Dreyer | 424/1 |
| 4,145,296 | * | 3/1979 | Fox et al. | 252/2 X |
| 4,297,452 | * | 10/1981 | De Koch et al. | 525/367 |
| 4,384,988 | * | 5/1983 | Schoenholz et al. | 252/610 |
| 4,402,364 | * | 9/1983 | Klein | 169/47 |
| 4,510,081 | * | 4/1985 | Bronner et al. | 252/610 X |
| 4,563,287 | * | 1/1986 | Hisamoto et al. | 169/46 |
| 4,770,794 | * | 9/1988 | Cundasawmy et al. | 169/45 X |
| 5,045,588 | * | 9/1991 | Arranga | 252/2 X |
| 5,062,996 | * | 11/1991 | Kaylor | 169/46 X |
| 5,112,533 | * | 5/1992 | Pope et al. | 252/2 X |
| 5,190,110 | * | 3/1993 | Von Blucher et al. | 169/46 |
| 5,496,475 | * | 3/1996 | Jho et al. | 252/2 |
| 5,518,638 | * | 5/1996 | Buil et al. | 252/2 |

FOREIGN PATENT DOCUMENTS

| | | |
|---|---|---|
| 3716304A | 11/1988 | (DE) . |
| 0199897A | 11/1986 | (EP) . |
| 064966A | 4/1995 | (EP) . |
| 2615399 | 11/1988 | (FR) . |
| 56-049167A | 5/1981 | (JP) . |
| 02120339A | 5/1990 | (JP) . |
| 03292969A | 12/1991 | (JP) . |

* cited by examiner

*Primary Examiner*—Andres Kashnikow
*Assistant Examiner*—Steven J. Ganey
(74) *Attorney, Agent, or Firm*—Birch, Stewart, Kolasch & Birch, LLP

(57) ABSTRACT

An original method and products are described for fire quenching in all substrata such as forests, cultivated areas, city areas, industrial units, transport vehicles, etc. Aqueous suspensions of fire quenching special products contain endomolecularly water up to 300 g water/g of polymeric product, and the water is kept very strongly so that pressure is needed to take the water out. These products are used in quantities of 1–3%, and to the quenching water are added complimentary other products such as detergents, emulsifiers, adhesion promoters, and inorganic products such as carbonates, sulfates silicones etc. Quenching fires utilizes the solution containing these or a selection of these products, and the solution is thrown in the fire edges to rapidly extinguish the fires, because the water contained in the special organic products is liberated in the fire edges, where quenching immediately occurs. As a result, excess quenching water enters the area, thereby creating non-flammable conditions in the whole area.

15 Claims, No Drawings

METHOD AND PRODUCTS TO FIGHT FIRES

This application is the national phase under 35 U.S.C. §371 of prior PCT International Application No. PCT/GR97/00028 which has an International filing date of Jul. 15, 1997 which designated the Unites States of America.

BACKGROUND OF THE INVENTION

The most extensive disasters nowadays which damage our global environment and threaten life are forest fires occurring every summer, (every year), by which more and more greenery is destroyed and life is endangered. The destruction of forests and elements of life by fires leads to ecological damage.

Extensive fires also result in abandonment mountainous areas by populations moving to plains and large cities which is connected with increases in water consumption, resulting to biological damage and to water balance alterations which may result to changes in face of the Planet. These changes of habitat has resulted to in the abandonment of the vast mountainous areas which largely control the water balance and the biological action on Earth.

There is need to improve fire fighting for survival. Man is rather weak in this area despite all transport means available for quenching water: aeroplanes, helicopters, ships, truck-tankers. The materials in use for fire fighting are water and carbon dioxide applied by all transport and delivery means mentioned, which are continuously improved but are not that successful to face the increase in fire damage. Additionally it has been scientifically proven that by bringing small quantities of water on the fire edges could be a successful fire fighting approach.

We have extensively studied the problem of fire fighting and have worked to advance products and techniques which lead to successful fire fighting. This original, highly profitable approach has been derived from our conviction that solutions providing for adding products to fire edges products that can release much water, by which the fire is very effective faced. In case where these products are organic and destroyed by burning their remains could secure non-inflamability in the area involved.

SUMMARY OF THE INVENTION

We have worked extensively to fulfil the above, and by R & D work we have developed original and most profitable products for that purpose. We have also advanced proper techniques leading to successful fire fighting. The products we have developed are derived from market polymers or from recycled polymers, which by successive processing become stable macroplegmatic and polar groups at high density are introduced with which the polymers acquire the capacity to absorb water up to 300 times there weight in which water is kept endomolecularly and the water is held thus very strongly. Great strength is needed to be applied to remove the water.

These products are easily suspended in water in pure form or with selective additives according to needs. The products which can be added as improvements are: detergents, emulsifiers, adhesives, products which do not burn such as carbonates, sulphates, silicates etc., so that the coverage of use can be highly expanded.

DETAILED DESCRIPTION

The polymeric products that endomolecularly absorb water up to 300 times are directed to the fire edges where they are burned, thereby releasing much water to fight the fire immediately and on a wide front. That result has been proven in wide practice with very successful results in speed of action, in difficult fire control and in wide coverage. The following describes some results of these applications.

a. Water to fight fire contains 2% polymeric material, 1% pulverized calcium carbonate and 0.5% detergent. This was used to fight a wood fire. A very rapid cessation of fire was observed and no fire could develop for 120 minutes.

b. Water to fight fire containing 1% polymeric material 1% pulverized calcium carbonate was used to fight fires developed in a forest. The fire ceased in a very short time and the area where the water solution was thrown did not retain firing ability.

c. Water was prepared containing in emulsion 2% polymeric material, 0.1% detergent and 1% starch to ensure emulsion stability. This was used to fight fires developed in car tires. The cessation of fire was rapid and there was no new fire could be developed in those tires.

d. After these successful trials, fire fighting from an airplane was demonstrated. The water containing 1% polymeric material by weight was thrown on the fire, followed by the very impressive result that the fire ceased quickly in a wide are, and the forest treated with the thrown solution did not show efficiency to develop a new fire.

The originality and the importance of our invention, dealing with a problem of survival in our planet, is evident. It shows high potential in dealing with fires. It makes a first such possibility to face efficiently the fires in city life, out of cities, in forests, in cultivated areas and everywhere in everyday life.

EXAMPLE 1

100 kg of recycled polystyrene is diluted in 300 liters of 1,2-dichloroethylene solvent and in that solution is added 1 kg of dibenzyl-X-dichloro-dibenzyl chloride as a crosslinking agent.

The resulting solution is heated to 40° C. and then 40 ml of concentrated sulphuric acid is added. After 5 minutes of agitation crosslinking had occurred,, and when the mixture cannot be further agitated the product is taken out, is minced in a machine and then is suspended into 300 liters of solvent. In the resulting suspension at 68° C. is added chlorosulfonic acid 2.2 M/M of benzene rings and begins sulphonation. The sulphonation reaction is followed with hydrogen chloride liberation. Then are gradually formed two layers, that of polymeric insoluble mass and that of solvents and those layers are separated by centrifuging in a decanter. The polymeric mass is neutralised with concentrated sodium hydroxide solution and then is directed in 20% sodium chloride solution where most of the water is expelled from the polymeric mass and the remaining water is taken out by taking the mass under electric voltage of 20 v, from which the polymeric mass is rendered practically free of water. The polymeric mass is finally taken into a reactor it is heated under vacuum up to 160° C. where the mass becomes soft and homogenic. Finally, it is taken into desalinated water and after 6 hrs. in it, the polymeric mass had water absorption capacity of 225 and an ionexchange strength of 4.94.

EXAMPLE 2

100 Kg polystyrene is dissolved in 300 liters of solvent where us added acetic acid (to resist sulfone group formation) in quantity of 15% to the solvent volume. It is subjected to sulphonation by adding chlorosulphonic acid 2.2 M/M of benzene rings as a 20% solution in the solvent at 68° C. where two layers are formed. These layers are separated by decanting and the polymeric product is further treated like example 1. Finally a product is obtained having water absorption capacity 350 and ionic exchange strength of 4.96.

EXAMPLE 3

10 kg of a 40:60 copolymer of acrylonitrile and styrene, is diluted into 30 liters of solvent containing 18% acetic acid and in that is added chlorosulphonic acid 2.2 M/M of benzene rings. After the sulphonation treatment a glassy product, insoluble is then separated by decanting. It is treated like in example 1 and finally a product is produced with two ionic groupings, one acetic and one sulphonic. The product finally had a water absorption capacity of 270.

EXAMPLE 4

Fully hydrogenated SBR in quantity of 10 kgs is diluted into 30 liters of solvent and crosslinked with agent dimbenzyl-X-dimethylobenzyl-chloride using sulphuric acid as catalyst according to the example 1. The thick mass resulted after 20 minutes agitation it was minced and subjected into 30 liters of solvent. Then it was sulphonated with oleum (60% $SO_3$) in quantity 3 M/M benzene rings at 10° with cooling. The final product after purification according to the above had a water absorption capacity of 103 and an ionexchange strength 4.1.

EXAMPLE 5

Preparation of Fire Fighting Products

Product A

To be used with water quenching in expanded areas.

The product of Examples 1 to 4 was used in pure form with water for equilibration.

The product of the resulting quality is thrown into quenching water in quantity 1–3% and is used to control fires by directing those products into the fire edges.

Product B

Product to be used for personal utilization to fight small fire accidents.

It is suggested to use the products in emulsions rather like in the following formulation:

| | |
|---|---|
| Polymeric product | 2–3% |
| Detergent | 0.1% |
| Starch or petroleum | 0.5% |

For better pumping because of higher viscosity inorganic pulverised products are added such as chalk, sulphates, sand, silicates.

Product C

To fight fires developed inorganic volatile solvents that burn easily, the action should be concentrated and rapid.

The polymeric products of 1–4 examples are utilized in higher concentrations up to 10% if that is possible, and are pumped at such facilities.

Remark. The polymeric products contain much water thus their pumping should not involve pressure. Application is by running water by applying water pressure or vacuum.

What is claimed is:

1. A method of quenching fires which comprises:

adding to a fire edge a product which comprises a multiprocessed macroplegmatic polymer having high density polar groups, wherein the polar groups have allowed the polymer to absorb endomolecularly up to 300 times the polymer weight of water, whereby the polymer decomposes to liberate the water to quench the fire at the fire edge so that an area about the fire edge becomes non-flammable.

2. The method according to claim 1, wherein the fire occurs in a forest, a cultivated area, a city, car tires, an industrial unit or a transport vehicle.

3. The method according to claim 1, wherein 1–3 wt. % of the product is mixed with water.

4. The method according to claim 3, wherein the product mixed with water is added to the fire using an airplane, a helicopter or a tanker which pumps water.

5. The method according to claim 3, wherein an excess of product is added to the fire edge, so that the area about the fire edge becomes non-flammable.

6. The method according to claim 3 wherein the water further contains a detergent, an emulsifier, an adhesive, pulverized calcium carbonate, pulverized calcium sulfate or pulverized silicate.

7. The method according to claim 6, wherein the water contains 2% of the polymer, 1% calcium carbonate and 0.5% detergent.

8. The method according to claim 6, wherein the water is an emulsion comprising 2% of the polymeric material, 0.1% of the detergent and 1% starch.

9. The method according to claim 1, wherein the polymer is polystyrene.

10. The method according to claim 9, wherein the polystyrene is crosslinked and sulfonated.

11. The method according to claim 1, wherein the polymer is SBR.

12. The method according to claim 11, wherein the SBR is crosslinked and sulfonated.

13. The method according to claim 1, wherein the polymer is a copolymer of acrylonitrile and styrene.

14. The method according to claim 13, wherein the copolymer is crosslinked and sulfonated.

15. The method according to claim 13, wherein the copolymer is 40:60 copolymer of acrylonitrile and styrene.

* * * * *